US005309851A

United States Patent [19]

Reimlinger et al.

[11] Patent Number: 5,309,851

[45] Date of Patent: May 10, 1994

[54] REGENERATIVE THERMAL OXIDIZER WITH GATE MANIFOLD PRESSURIZATION

[76] Inventors: Richard G. Reimlinger, 24 Hunter Ave., Fanwood, Union County, N.J. 07023; James L. Nester, 1601 Moyer Rd., Upper Salford Township, Montgomery County, Pa. 18969

[21] Appl. No.: 91,268

[22] Filed: Jul. 15, 1993

[51] Int. Cl.[5] ..... F27D 17/00; F28D 17/04

[52] U.S. Cl. ..... 110/304; 110/302; 165/4; 165/9; 137/309

[58] Field of Search ..... 165/4, 7, 9; 110/304, 110/302; 137/309-311

[56] References Cited

U.S. PATENT DOCUMENTS

| | | | |
|---|---|---|---|
| 634,907 | 10/1899 | Newell | 137/309 |
| 927,930 | 7/1909 | Von Brechen | 137/310 |
| 3,170,678 | 2/1965 | Keefer | 137/309 |
| 3,225,819 | 12/1965 | Stevens . | |
| 3,741,286 | 6/1973 | Muhlrad . | |
| 4,280,416 | 7/1981 | Edgerton | 165/4 |
| 4,470,806 | 9/1984 | Greco | 432/182 |
| 4,754,806 | 7/1988 | Astle, Jr. . | |
| 4,966,228 | 10/1990 | Fawcett . | |
| 5,026,277 | 6/1991 | York | 432/181 |
| 5,134,945 | 8/1992 | Reimlinger et al. | 110/364 |

FOREIGN PATENT DOCUMENTS

| | | | |
|---|---|---|---|
| 1256073 | 12/1971 | United Kingdom | 165/4 |

*Primary Examiner*—Albert W. Davis, Jr.
*Attorney, Agent, or Firm*—Kenneth P. Glynn

[57] ABSTRACT

The present invention involves a regenerative thermal oxidation apparatus for purifying gases by thermal oxidation and for exchange of heat between inleting and outleting gases. The apparatus has a plurality of thermal chamber units, each such unit having a gate with at least one gate orifice movably located in a linear fashion against a base surface so as to alternatively align with various inlet and outlet openings. The improvement involves the use of a plurality of seals located between the gate and the openings with sufficient sealing capabilities between the gate and the openings to maintain each chamber at an elevated pressure, i.e. above atmospheric pressure, and so as to reduce leakage of gases from each of the chambers and reduce condensation during operation. The invention is also directed to the method utilizing this apparatus.

18 Claims, 3 Drawing Sheets

REGENERATIVE THERMAL OXIDIZER WITH GATE MANIFOLD PRESSURIZATION

BACKGROUND OF THE INVENTION

1. Field of the Invention

The present invention is directed to an improved method and apparatus for regenerative thermal oxidation. More specifically, it is a method and a thermal oxidizer for purifying gases by incineration while providing regenerative heat exchange between inleting and outleting gases, and, optionally, providing for purging of gases in individual thermal chambers. Such systems are used in commercial and industrial operations for removal of air pollutants from gases which would otherwise be released to the atmosphere. By thermal oxidation, these gases are raised to their auto ignition temperature, creating safer, and more simple exhaust gas compounds. By using proper heat exchanger techniques, as described herein, the efficiency in the cost of operation is enhanced. A majority of applications in pollution control involve condensable organics in process exhaust. Conventional inlet butterfly valves or dampers become extremely susceptible to these condensables, which will cause improper valve sealing and lower destruction efficiencies. Many manufactures have devised systems to control the build-up of condensables on their inlet valves. All of these control systems can only be run when the system is not processing fume, and with added cost to the base system. The present invention does not have separate "inlet" or "outlet" valves, only one blade that continuously cycles between inlet and outlet modes. This continuous cycling will cause the blade to reach an equilibrium temperature between the inlet and outlet temperatures. This means the blade will, always be hotter than the inlet air stream and will not cause process fumes to condense. The specific improvement, and preferred embodiment, involves the utilization of hot exhaust air to pressurize the area around the gates in order to minimize leakage and to increase thermal and oxidation efficiency.

2. Information Disclosure Statement

Regenerative thermal oxidizers such as in the present invention, utilize a back flow of gases through the heat exchanger to maximize the recapture of heat which might otherwise be lost to the atmosphere. These systems include minimally a combustion chamber which receives the preheated gas, and recovery chamber which cools the gas exiting so as to reclaim most of the heat, to be applied to the inleting process gas before entering the combustion chamber. A burner is used to maintain temperature in the combustion chamber. Typically the system operates dynamically holding inlet and outlet conditions for a predetermined period of time before continuing on to the next inlet/outlet condition. In this manner, the regenerator could become one of a heating regenerator rather than an exhaust regenerator and the portion or unit which constituted the heating regenerator could become the cooling regenerator.

Early regenerator systems involved the use of, for example, two chambers wherein the gases to be purified entered into the bottom of one chamber, rose up therethrough for oxidation, and back down through and out a second chamber unit for capture of the heat. Operated in this manner, for a period of time, the process was reversed so that the inlet gas is now moved first into what was the exhaust chamber utilizing the energy for preheat. One of the problems which existed during the flow reversal involved large pressure swings which create back pressure effecting manufacturing systems which require equilibrium within the system. Oxidizers with three or more chambers can make use of an idle chamber which transitions with one or more of the other chambers to maintain an even flow across the systems during changes in airflow direction through the equipment. Difficulties arose with respect to the manifolding of these gases because, historically, flap valves which rotated were utilized to provide the inleting and outleting of the process exhaust gases. This caused inefficiencies, improper sealing problems, mechanical wear and tear due to the rotational aspects thermal expansion problems, and pockets of process air which would not be treated after the flap valves transitioned from inlet to outlet positions. In addition, flap valves require a complicated array of control to insure each valve is opening and closing properly. In fact prior art makes no provision for allowing both inlet and outlet flap valves from opening and closing simultaneously, allowing contaminated air to bypass the oxidation chamber and be exhausted, unprocessed, to the atmosphere.

Various solutions have been developed to address problems incurred in regenerative heat chambers, although the prior art does not teach or suggest the present invention described herein. The following patents are representative of the state of the art:

U.S. Pat. No. 3,741,286 issued to Wolf Muhlrad described a regenerative heat exchanger and method for purging its flow passages. The invention described involves double chambers with gases passing up one side and down the other and then reversing. This is accomplished by rotation of a series of dampers which do not eliminate the above mentioned problems with rotational valves.

U.S. Pat. No. 4,470,806 issued to Richard Greco described regenerative incinerators utilizing a series of heat exchanger chambers with perforated horizontal support grates with combustion chambers located above heat exchangers and utilizes openings and closing of various lines to achieve reversals for heat exchange. However, as in the other prior art, this patent utilizes valves which rotate to open and close the inlet and outlet manifolds.

U.S. Pat. No. 3,225,819 issued to E. S. Stevens describes an apparatus and method for air-to-air heat exchange, but again, utilizes rotational valving.

U.S. Pat. No. 4,754,806 describes a reciprocating heat exchanger and utilizes a porous metal element for absorbing heat for the exhaust air stream and also describes movement of this porous metal element from one side to another so as to effectively exchange heat by receiving heat from exiting gases and moving it over to inlet gas lines. However, this patent does not describe valving or manifolding and takes a totally different approach by never reversing the flow of gases but only reciprocally relocating heat absorbing elements.

U.S. Pat. No. 4,966,228 and U.S. Pat. No. 5,026,277, describe some recent developments of the art in this field. The latter patent to James York describes a regenerative thermal incinerator apparatus utilizing a system of valved duct work to direct gases to various combustion chambers and to idle a third regenerator for purging of partially treated gas so as to recycle it back through the system and so as to, thereby, reduce or eliminate lost gases which have not been properly purified.

U.S. Pat. No. 4,280,416 issued to Phillip Edgerton, describes a rotary valve for regenerative thermal reactors. While this patent describes valves which rotate instead of swing or rotate about an axis parallel to the valve surface, it still requires rotation of a valve about an axis at right angles to its surface and rotational friction and mechanical drive is necessitated.

U.S. Pat. No. 4,966,228 issued to Sherwood Fawcett describes a regenerative gas-to-gas heat exchanger requiring a special geometry for a chamber and utilizing gate valves to direct or, redirect gases through different chambers. Unlike the present invention, however, Fawcett does not reverse gas flow and Fawcett does not rely upon the use of sliding gates having an orifice which is moved from an inlet to dead space or closed off space to an outlet and recycled back and forth so as to control the flow of gases in one direction and then in the exact opposite direction within a specific chamber unit.

U.S. Pat. No. 5,134,945 to the present inventors herein describes the present state of the art in the field. The thermal oxidizers described therein utilize at least three regenerative thermal chamber units and these have on a single surface both inlet and outlet openings with slidable, controlled and timed gates to set opened or closed each of the inlet and outlet openings to shift regeneration inlet and outlet from chamber unit to chamber unit. This prior art patent does disclose overall oxidizer purging based on inleting purge gases through the top of the entire set of units for purging, but neither suggests nor teaches the pressurization of the units by sealing of the gate manifolds, as set forth in the present invention.

SUMMARY OF THE INVENTION

The present invention is directed to an improved regenerative thermal oxidizer and a method of purifying gases by raising gases to their auto ignition temperature and by exchanging heat by inleting and outleting gases. The reactor has a plurality of regenerative thermal chamber units and these units have on a single surface at least two openings, an inlet opening and an outlet opening, and an optional purge gas opening in some embodiments, which are connected to inlet and outlet gases and to recycled outlet gases for purging, respectively. Set against the openings is a slidable gate which has a single opening which moves through cycles so that its single opening coincides with the various openings of its chamber unit, and with spaces closed between the inlet and outlet opening, or with the purge opening, or coincide with the outlet opening. In other words, the gate cycles between inleting gases, no gas movement, optional, purge position, and outleting gases. There are means provided for moving the gate through the aforesaid cycle and, inlet ducts, purge ducts and outlet ducts are connected to their respective openings. The improvement herein relates to pressurization of the oxidizer gate areas and its units preferably with hot, clean, exhaust air by providing seals around the inlet and outlet openings to prevent leakage and maintain high pressures. Optional purging may also increase pressure further and enhance leakage prevention. The method involves utilizing the aforesaid apparatus so as to purify gases by thermal oxidation and to create efficient heat exchange as well as efficient oxidation.

BRIEF DESCRIPTION OF THE DRAWINGS

The present invention will be more fully understood when the specification herein is taken in conjunction with the appended drawings. These drawings illustrate the following.

DETAILED DESCRIPTION OF THE INVENTION

The present invention is directed to improved thermal oxidizers developed to eliminate rotation or revolution of valve mechanisms in regenerative thermal oxidation chamber unit inlets and outlets. Thus, it is an objective of the present invention to provide gates which neither rotate nor revolve but merely slide back and forth. This can be accomplished with vertical or horizontal or otherwise positioned gates without exceeding the scope of the present invention.

It is also an object of the present invention to eliminate or substantially reduce problems typical of the rotational valves, sealing problems and heat loss problems resulting from such inefficiencies, thereby substantially increasing the efficiencies of the system.

It is an object of the present invention to provide seals around inlet and outlet openings against the gates to increase pressure in the units to increase efficiencies and decrease leakage.

It is also an object of the present invention to provide for optional purging of each chamber unit in a regenerative oxidizer, either on an as needed basis or as in preferred embodiments, automatically for each individual chamber unit.

It is an object of the present invention to also provide a new, reliable, different and more cost effective mechanism for reversing gas flow in chamber units for regenerative thermal oxidation systems with increased pressurization and optional selective purging included.

It is also an object of the present invention to permit chambers to be idle for purposes of purging or otherwise and to operate on a cycle with continual switching and reversing of chambers and gas flow direction which includes leakage prevention and which may include automatic purging.

Figure 1:
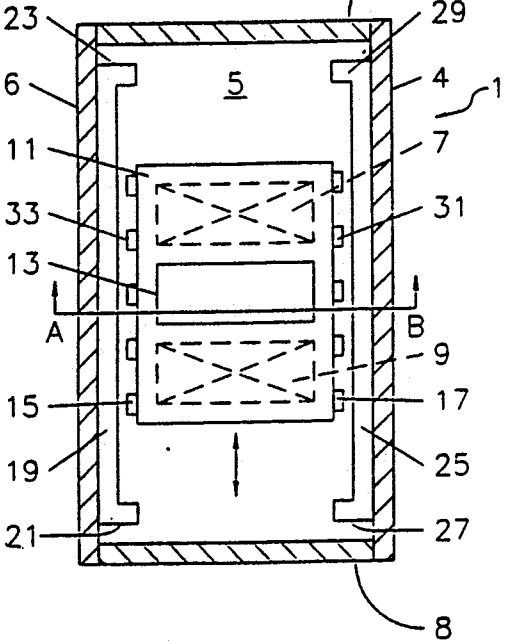
FIG. 1 is a cut top view of a single chamber unit of a regenerative thermal oxidizer of the prior art.

FIG. 1 shows a top cut view of a single regenerative thermal chamber unit 1 of a recent prior art invention to the present inventors herein with a multi-unit reactor apparatus. This unit 1, has a lower receiving chamber and an upper combustion chamber.

Unit 1 has walls 3, 4, 6 and 8 and a base surface 5. In this embodiment, the base surface 5 is a bottom surface, but it could be otherwise, e.g. a side surface. Base surface 5 includes a gas inlet opening 7 and a gas outlet opening 9. Here, openings 7, 8, and 9 are rectangular, but they could be of any configuration, such as a square or a round orifice. They are separated or spaced apart by a distance, which is at least equal to the width of a gate orifice 13. Gate 11 movably rests atop and against base surface 5 and contains gate orifice 13, as shown.

Gate 11 moves through cycles with critical positions for advanced manifolding of unit 1. One critical position occurs when gate orifice 13 seats against gas inlet opening 7. In this position, gas outlet opening 9 is closed and only inlet gases enter chamber unit 1. A second critical chamber position is when gate orifice 13 rests against base surface 5 at an area between openings 7 and 9.

This is as shown in FIG. 1 and in this position, inlet opening 7 and outlet opening 9 are closed. In a third critical position, gate orifice 13 is seated against outlet opening 9 and gases only exit the chamber unit 1.

Figure 2:
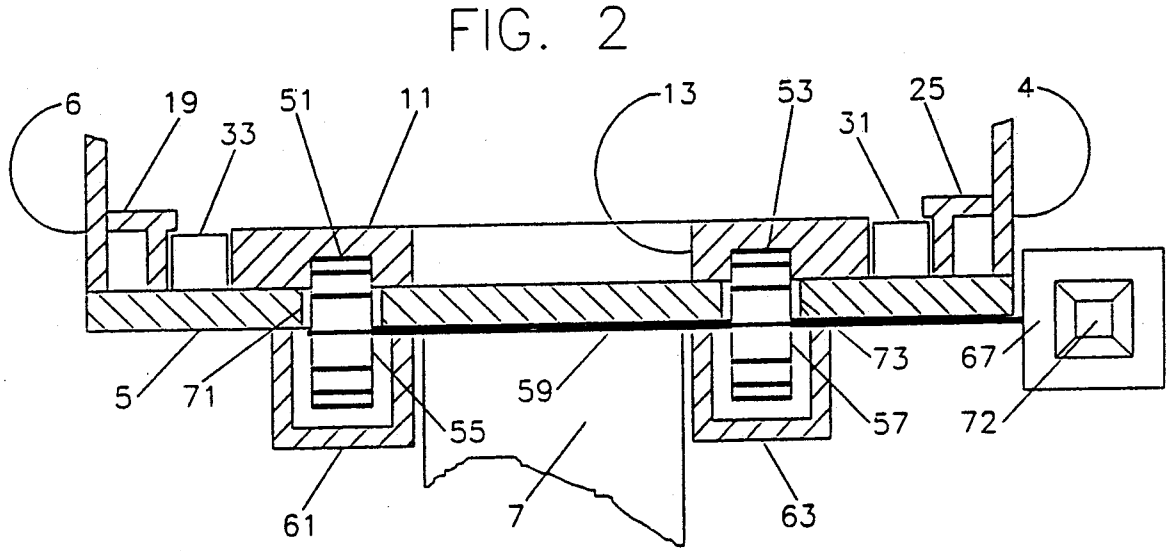
FIG. 2 shows a cut end view of a portion of the chamber unit shown in FIG. 1.

FIG. 2 shows an end cut view of the chamber unit 1 of FIG. 1 along line AB.

Referring now to both FIGS. 1 and 2 taken together, and in which identical components are identically numbered, gate 11 includes roller wheels 15, 17, 31 and 33 (typical). Guide brackets 19 and 25 are also shown and include ends 21, 23, 27 and 29. While guide brackets and wheels are shown in this embodiment, other guide means could be used or none could be employed if the gate where sized or seated or if the gate relied upon gravity, e.g. was on pulleys on a side wall. In fact, any known arrangement for maintaining a slide plate or gate in position for opening and closing may be used.

Gate 11 has cut outs 51 and 53 on its underside and these mesh with gears 53 and 57, which pass through gear openings 71 and 73 in base surface 5. Gears 53 and 57 are connected to axle 59, which is driven by motor 67 and controlled by computer 72. The control involves movement of gate 11 from one end of the brackets 19 and 25 to the other end and back again, completing a cycle. The gate 11 may be stopped for a preset time at each of its critical positions mentioned above or continuously move during the cycle. The controls may be by electric timers, mechanical cycling wheels, hydraulics, pneumatics, computer, a combination of these or otherwise.

While FIGS. 1 and 2 generally show a prior art system, it should be noted that the overall arrangements, plumbing, cycles, drive mechanisms, and structures of the present invention are the same, except for pressurization by seals at the gates and around the openings, with or without purging.

Figure 3:
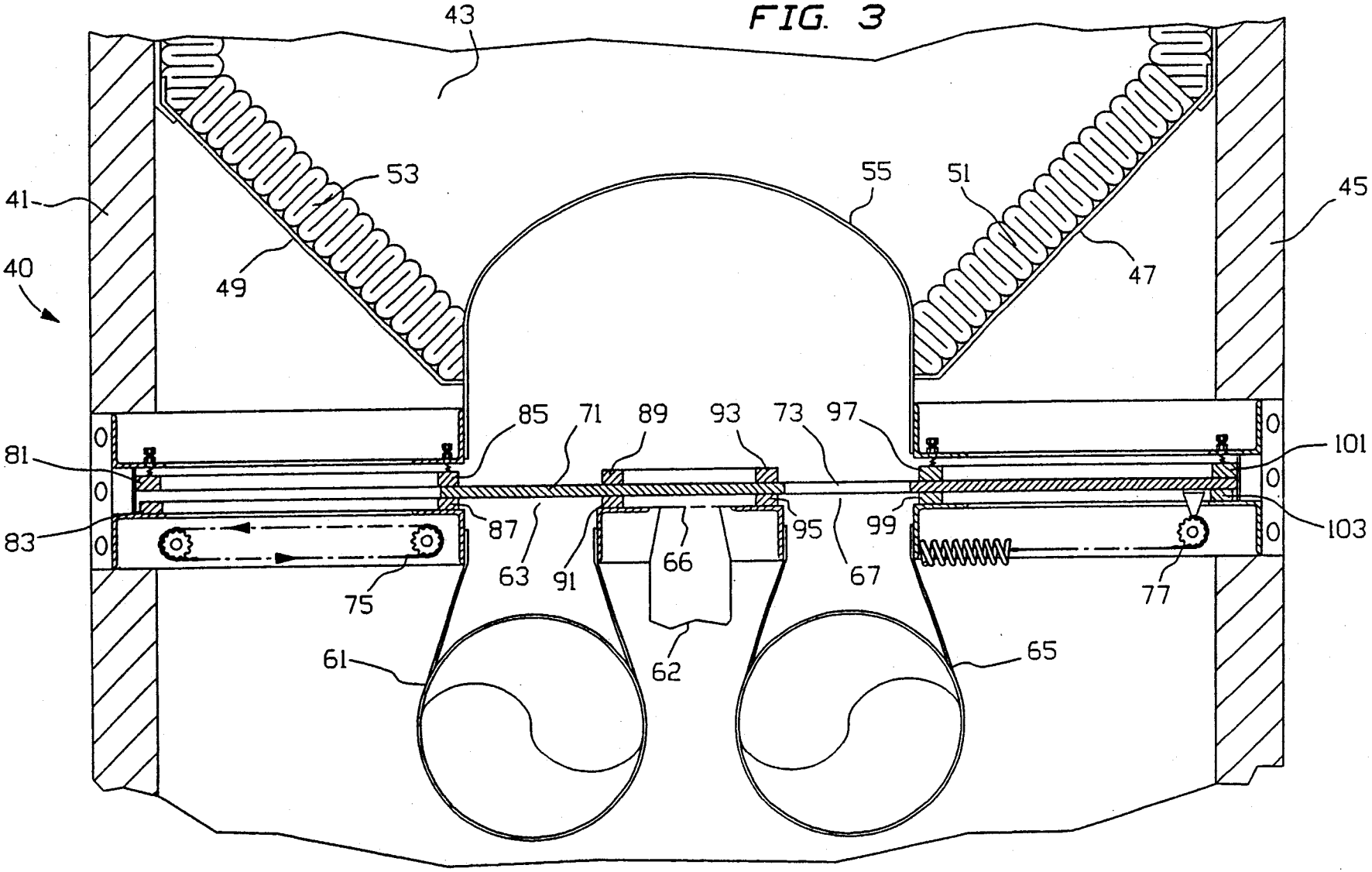
FIG. 3 shows a partial cut front view of a chamber unit utilized in the present invention including the sealed gate, the drive mechanism and the seals; and, FIG. 4 shows a side cut view of a portion of the unit shown in FIG. 3.

Referring to FIG. 3, there is shown a front, cut view of a portion of a single chamber unit utilizing the pressurized gate of the present invention. Here chamber unit 40 has walls 41, 43 and 45 which could form a rectangular footprint or be portions of a circular or oval chamber. Supports 47 and 49 hold insulation coils 51 and 53, as shown. Distribution grid 55 distributes gases, e.g. as a perforated dome (perforations not shown), and supports catalyst or heat distribution masses, e.g. ceramic works or saddles (not shown).

Inlet conduit 61 is connected to inlet opening 63 and outlet conduit 65 is connected to outlet opening 67. Optional purge gas opening 66 is connected to purge gas conduit 62. Purge gases may be taken off the outlet exhaust, i.e. may be recycled cleaned gases. Purging is preferred, but FIG. 3 could illustrate an embodiment without purge gas opening 66 and conduit 62 and still be within the present invention scope. Gate 71 with orifice 73 moves left to right and vice versa to cycle its positioning for opening inlet opening 63, closing purge gas opening 66 and closing outlet opening 67, then closing the inlet and outlet openings while purging, then closing inlet opening 63 and opening outlet opening 67, and then reversing the sequence. Chain drive 75 drives the gate 71 and spring/chain drive 77 returns the gate 71 to its starting position.

The improvement to the system involves pressurization of the chamber unit 40 by using proper seals on gate 71 at all times during operation. Thus, seals 81, 83, 85, 87, 89, 91, 93, 95, 97, 99, 101 and 103 are maintained to prevent pressure leakage and, therefore, gas leakage, to increase both thermal and oxidation efficiency. Note that the aforementioned seals may in pairs, be portions of ring seals or separate segments. They are formed of metal, e.g. rings, half rings, frames, plates, elongated strips, etc. and may include adjustments. The seals prevent leakage of inlet gases into the chamber when inlet opening 63 is closed and prevent outlet gases from backing into chamber 40 when inlet gases are entering through inlet opening 63. Further, the seals prevent inlet gases, purge gases and outlet gases from exiting the chamber 40 around gate 71 during operation, thus maintaining higher pressures and increasing efficiencies, both thermal and reactive. Finally, the purging step takes place when gate 71 has its orifice 73 over purge gas opening 66. The entering purge gases maintain chamber pressure, blow out oxidized and used gases and prevent exit of unreacted inlet gases.

Figure 4:
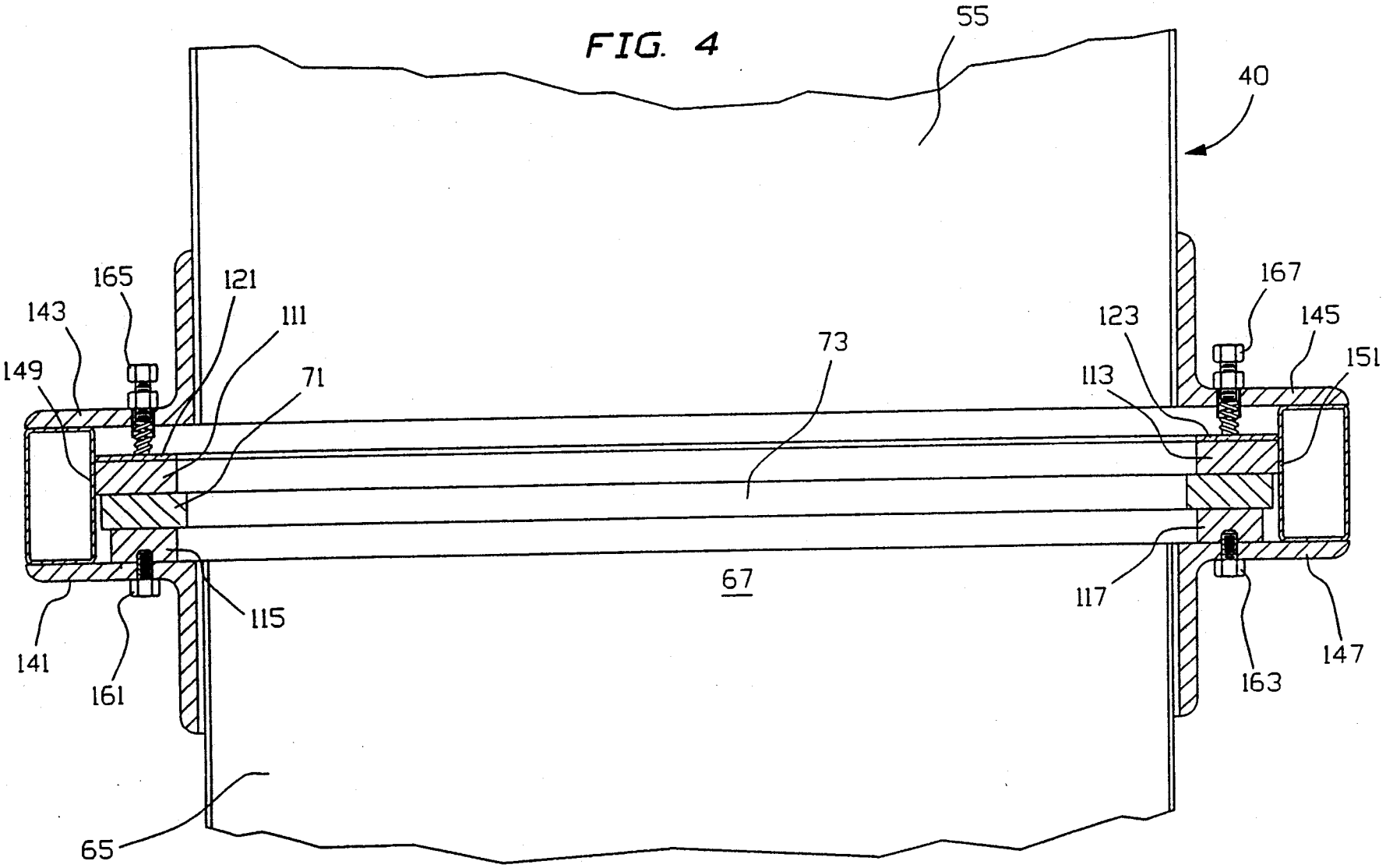

FIG. 4 shows a side cut portion of a part of the FIG. 3 chamber 40. Here identical parts are identically numbered, except that there is assumed here to be seals in the form of segments, so that seals shown in this side view are numbered differently from corresponding seals or seal segments shown in FIG. 3. Angle beams 141, 143, 145 and 147 for the basis support structure for the gates with channels 149 and 151 acting as spacers and end walls. On the left side of gate 71, bottom seal 115 is bolted by bolt 161 to angle beam 141 and gate 71 slides over the seal with same friction. Top seal 111 is pressed down upon gate 71, has an overplate section 121 and is adjustably tightened to a desired pressuring with spring bolt 165. Likewise, right side has corresponding bottom seal 117 with bolt 163, as well as top seal 113, overplate section 123 and adjustable spring bolt 167.

Referring to both FIGS. 3 and 4, it can now be seen that a double seal exists between inlet opening 63 and outlet opening 67, due to seals around each.

During directional airflow changes within early design recovery chambers, fume is trapped beneath and throughout the recovery chambers. This volume is discharged, unprocessed, to the atmosphere further reducing the destruction efficiency capabilities of the oxidizer. Current designs have minimized this volume, but are severely limited due to the various configurations of their equipment. The present invention oxidizer with the gate manifold and the pressurization of the units dramatically reduces this volume.

Pressurizing the "dead chamber" with exhaust air as previously described prevents valve leakage. With the pressurization of the gate, and especially with purging, stack air is used to force the trapped fume up into the recovery chamber during the idle position and into the combustion chamber. This will effectively eliminate any trapped volume bypassing the oxidation process.

A majority of applications in pollution control involve condensable organics in process exhaust. Conventional inlet butterfly valves or dampers become extremely susceptible to these condensables, which will cause improper valve sealing and lower destruction efficiencies. Many manufactures have devised systems to control the build-up of condensables on their inlet valves. All of these control systems can only be run when the system is not processing fume, with added cost to the base system. The present invention improved oxidizer is different. It does not have separate "inlet" or "outlet" valves, only one blade that continuously cycles between inlet and outlet modes. This continuous cycling will cause the blade to reach an equilibrium temperature between the inlet and outlet temperatures. This means the blade will always be hotter than the inlet air stream and will not cause process fumes to condense.

Other variations should now be seen obvious to the artisan in view of the detailed description and appended drawings. For example, the gates could be in a non-horizontal plane, e.g. slanted or vertical plane. Also, the base surface of the present invention reactor and gate need not be flat. The base surface and the gate could be arctuated and operate without exceeding the scope of the invention. This would be the case utilizing a vertical gate within a circular chamber unit. Also, the purge gas opening need not be between the inlet and outlet openings but could be on the outside of one or the other, i.e. at the end of the gate movement so as to have a single purge rather than two purges for each complete cycle. Further, the above representations are presented to be merely illustrative and the scope of the present invention should not be construed to be strictly limited to the particular examples set forth above.

Obviously, numerous modifications and variations of the present invention are possible in light of the above teachings. It is therefore understood that within the scope of the appended claims, the invention may be practiced otherwise than as specifically described herein.

What is claimed is:

1. In a regenerative thermal oxidation apparatus for purifying gases by thermal oxidation and for exchange of heat between inleting and outleting gases, said apparatus having a plurality of thermal chamber units, each such unit having a gate with at least one gate orifice movably located in a linear fashion against a base surface so as to alternatively align with various inlet and outlet openings, the improvement which comprises:

a plurality of seals located between said gate and said openings and having sufficient sealing capabilities between said gate and said openings to maintain each chamber at an elevated pressure and so as to reduce leakage of gases from each of said chambers during operation.

2. The apparatus of claim 1 wherein at least one seal seals each of said inlet openings and one seal seals each of said outlet openings.

3. The apparatus of claim 1 wherein seals are located above said gates and below said gates.

4. The apparatus of claim 2 wherein seals are located above said gates and below said gates.

5. The apparatus of claim 1 wherein said thermal chamber units further include a purge gas opening in said base surface.

6. The apparatus of claim 2 wherein said thermal chamber units further include a purge gas opening in said base surface.

7. The apparatus of claim 3 wherein said thermal chamber units further include a purge gas opening in said base surface.

8. The apparatus of claim 4 wherein said thermal chamber units further include a purge gas opening in said base surface.

9. The apparatus of claim 5 wherein said purge gas openings are located between said inlet openings and said outlet openings.

10. In a method for purifying gases by thermal oxidation incineration and for exchange of heat between inlet and outlet gases utilizing an apparatus having a plurality of thermal chamber units, each such unit having a gate with at least one gate orifice movably located in a linear fashion against a base surface so as to alternatively align with various inlet and outlet openings, the improvement which comprises:

increasing the thermal and oxidation efficiency of said method by providing a plurality of seals located between said gate and said openings, having sufficient sealing capabilities between said gate and said openings to maintain each chamber at an elevated pressure and so as to reduce leakage of gases from each of said chambers during operation.

11. The method of claim 10 wherein at least one seal seals each of said inlet openings and one seal seals each of said outlet openings.

12. The method of claim 10 wherein seals are located above said gates and below said gates.

13. The method of claim 11 wherein seals are located above said gates and below said gates.

14. The method of claim 10 wherein said thermal chamber units further include purge gas openings in said base surface and said method includes purging said chamber units by predetermined alignment of the gate orifices with said purge gas openings.

15. The apparatus of claim 11 wherein said thermal chamber units further include a purge gas opening in said base surface.

16. The apparatus of claim 12 wherein said thermal chamber units further include a purge gas opening in said base surface.

17. The apparatus of claim 13 wherein said thermal chamber units further include a purge gas opening in said base surface.

18. The apparatus of claim 14 wherein said purge gas openings is located between said inlet openings and said outlet openings.

* * * * *